US011904219B1

(12) United States Patent
Hillary

(10) Patent No.: US 11,904,219 B1
(45) Date of Patent: Feb. 20, 2024

(54) BASKETBALL REBOUNDING APPARATUS

(71) Applicant: Greg Hillary, Chubbuck, ID (US)

(72) Inventor: Greg Hillary, Chubbuck, ID (US)

( * ) Notice: Subject to any disclaimer, the term of this patent is extended or adjusted under 35 U.S.C. 154(b) by 0 days.

(21) Appl. No.: 18/233,449

(22) Filed: Aug. 14, 2023

Related U.S. Application Data

(60) Provisional application No. 63/405,529, filed on Sep. 12, 2022.

(51) Int. Cl.
*A63B 69/00* (2006.01)
*A63B 63/08* (2006.01)

(52) U.S. Cl.
CPC ..... *A63B 69/0071* (2013.01); *A63B 63/083* (2013.01); *A63B 2225/093* (2013.01)

(58) Field of Classification Search
CPC ..... A63B 69/0071; A63B 63/083
USPC ..... 473/449, 482, 485, 487, 479, 433, 432
See application file for complete search history.

(56) References Cited

U.S. PATENT DOCUMENTS 5,098,090 A * 3/1992 Juhl ..... A63B 63/083 473/433
5,348,290 A * 9/1994 Matherne ..... A63B 63/083 473/433
5,746,668 A * 5/1998 Ochs ..... A63B 63/083 473/433
5,803,837 A * 9/1998 LoFaso, Sr. ..... A63B 69/0071 473/448
7,841,957 B1 * 11/2010 Wares ..... A63B 69/0071 473/433
8,128,517 B2 * 3/2012 Blair ..... A63B 63/083 473/433
2009/0203472 A1 * 8/2009 Snyder ..... A63B 63/083 473/433
2010/0113189 A1 * 5/2010 Blair ..... A63B 69/0071 473/433

* cited by examiner

*Primary Examiner* — Mitra Aryanpour

(57) ABSTRACT

The basketball rebounding apparatus includes a first frame having a first arm and a second arm. The first and second arms lead to a second frame. The second frame may be hingedly coupled to the first and second arms, thereby the second frame may descend away from the first and second arms. The basketball rebounding apparatus may have a spring that controls the second frame. When a basketball passes through a basketball hoop and the basketball rebounding apparatus, it will travel towards the second frame via the first and second arms. Once the basketball contacts the second frame, it will be in a stationary position until removed by a user.

17 Claims, 12 Drawing Sheets

BASKETBALL REBOUNDING APPARATUS

CROSS-REFERENCE TO RELATED APPLICATIONS

This application claims the benefit of U.S. Provisional Application Ser. No. 63/405,529, filed on Sep. 12, 2022, which is incorporated herein by reference.

TECHNICAL FIELD

The present disclosure relates to a basketball rebounding apparatus. More particularly, the present disclosure relates to an adjustable rebounding apparatus that can be used for all ages.

BACKGROUND

Basketball has been around since the late 1800s. Since then, it has become an international sensation and an integral part of American culture that affects the lives of both young and old. The game has evolved over the years in the equipment used, such as the basketballs and basketball hoops, and training has changed dramatically. There have been many companies focused on developing training equipment to make a basketball player quicker and stronger so as to get the most out of the player. Some of the training equipment found on the market includes passing machines, weighted gloves, and shooting aids. Training for a basketball player is essential to develop a player's skills.

One aspect of training that is essential to a player being successful at all levels of play and on both ends of the court (defensive and offensive ends) is rebounding the basketball. There are numerous training drills to help a player develop rebounding skills. These drills may include timing and jumping, box out techniques, and reaction rebounding, to name a few. A lot of these drills require the help of a coach or teammates to perform them properly. At times, it is not feasible to practice with a coach or a team. Furthermore, a lot of these drills do not teach strength, timing, or jumping skills that are needed to rebound a basketball properly. Some of these drills are also difficult to learn and to practice.

Accordingly, there is a need for an apparatus that can be used alone or with others, increases a player's strength, timing, and jumping skills, and is easy to use. The present invention seeks to solve these and other problems.

SUMMARY OF EXAMPLE EMBODIMENTS

In one embodiment, a basketball rebounding apparatus comprises a first frame with a first arm and a second arm coupled thereto. The first frame may be cylindrical and rest upon an upper surface of a basketball rim. The first frame may comprise an aperture that allows a basketball to pass therethrough. The first frame may comprise a plurality of first fasteners so as to allow the first frame to couple to the basketball rim.

The first and second arms may couple to a bottom surface of the first frame via, for example, welding, nuts and bolts, or any other type of coupling mechanism. In particular, a first end of the first and second arms may couple to the first frame. Further, a second end of the first and second arms may receive a second frame that is hingedly coupled thereto with a second fastener. The second frame may further comprise a support member that may be coupled to a lower surface of the second frame, thereby adding additional support. The support member may include a first bracket coupled thereto. It will be appreciated that the second frame can hold a basketball in place so that a user can pull it from the second frame. That is, after a user shoots the basketball and it goes in the basketball hoop, the basketball will pass through until stopping on the second frame, where it will stay until removed by a user.

The basketball rebounding apparatus further includes a cage coupled thereto that retains a basketball after a user shoots the ball into the basketball hoop. The cage may comprise a first cage member, a second cage member, a third cage member, and a fourth cage member. The fourth cage member may comprise a second bracket that descends below the fourth cage member.

In addition, a pneumatic spring may control the motion of the second frame. That is, when a user places a certain amount of pressure on the pneumatic spring, the second frame may lower, thereby releasing a basketball to the user.

In one embodiment, an adjustable basketball hoop comprises a back panel (i.e., backboard), a rim, a first shaft positionable into a second, larger shaft and the first and second shafts positionable into a third shaft that is larger than both the first and second shafts. With the shafts positionable one inside the other, the adjustable basketball hoop can be raised or lowered to numerous heights. The adjustable basketball hoop further comprises a base with a first support arm and a second support arm hingedly coupled to the third shaft. In addition, the third shaft is coupled to the base via a bracket comprising a first sidewall and a second sidewall. It will be appreciated that the third shaft may be hingedly coupled to the bracket so that the third shaft may fold and contact the base. Once against the base, the adjustable basketball hoop may be easily transported.

In one embodiment, a basketball rebounding apparatus comprises a first frame removably attachable to a first arm and a second arm. The first frame may comprise a plurality of first fasteners so as to allow the first frame to couple to a basketball rim. The first fasteners may comprise a first finger and a second finger at a first end, with a channel interposed between the first and second fingers. When the first fasteners are in position, the first frame 302 may be coupled to the basketball rim. Furthermore, the first frame may comprise a first receiving member and a second receiving member. The first and second receiving members may be configured to receive the first and second arms and be removably attachable.

A second end of the first and second arms may receive a second frame that is hingedly coupled thereto. The basketball rebounding apparatus further includes a cage that retains a basketball after a user shoots the ball into the basketball hoop. The cage may comprise a first cage member, a second cage member, a third cage member, and a fourth cage member. The first cage member may couple to the first and second arms via a first, curved coupler on the first arm and a second, curved coupler on the second arm. In addition, a spring may control the motion of the second frame.

Once the basketball rebounding apparatus is coupled to the rim of the basketball hoop, a user may shoot the basketball through the basketball hoop so as to position the basketball on the second frame, the second frame being in a first, resting position. At that point, a user may jump up and pull the basketball down, thereby activating the spring to release the basketball, moving the second frame to a second, release position. After the basketball is removed, the second frame via the spring may automatically reset to the first position, ready to receive another basketball.

DETAILED DESCRIPTION OF EXAMPLE EMBODIMENTS

Figure 1:
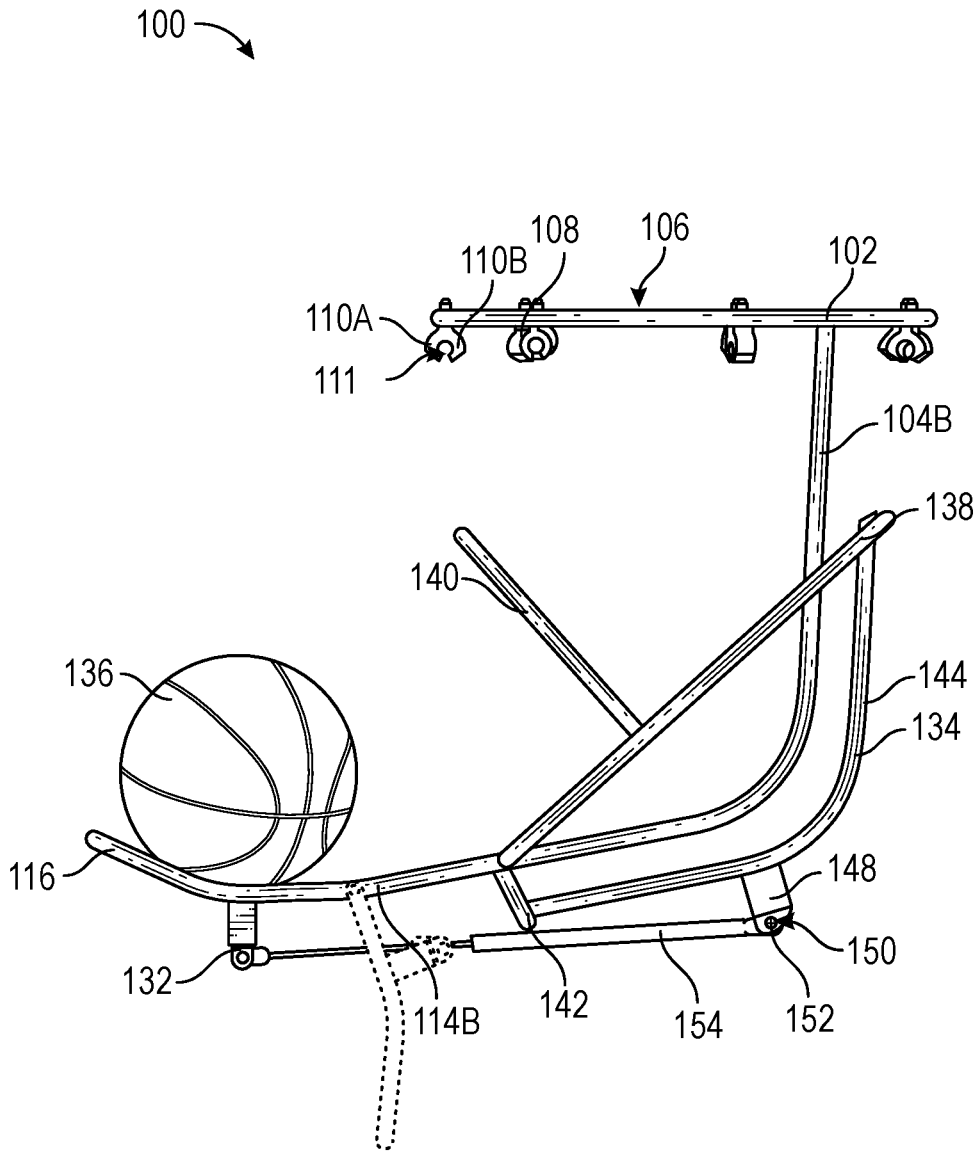
FIG. 1 illustrates a side elevation view of a basketball rebounding apparatus.
Figure 2:
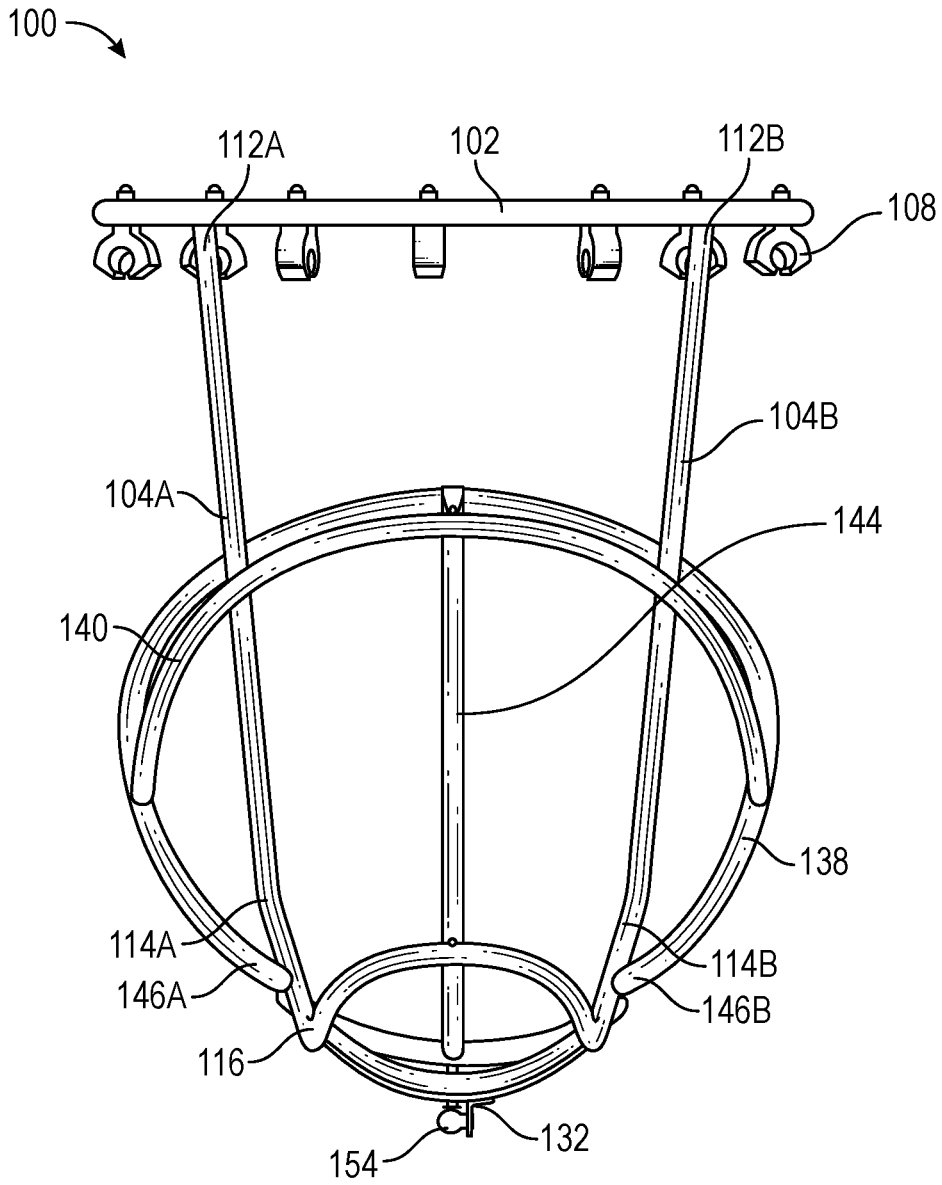
FIG. 2 illustrates a front elevation view of a basketball rebounding apparatus.
Figure 3:
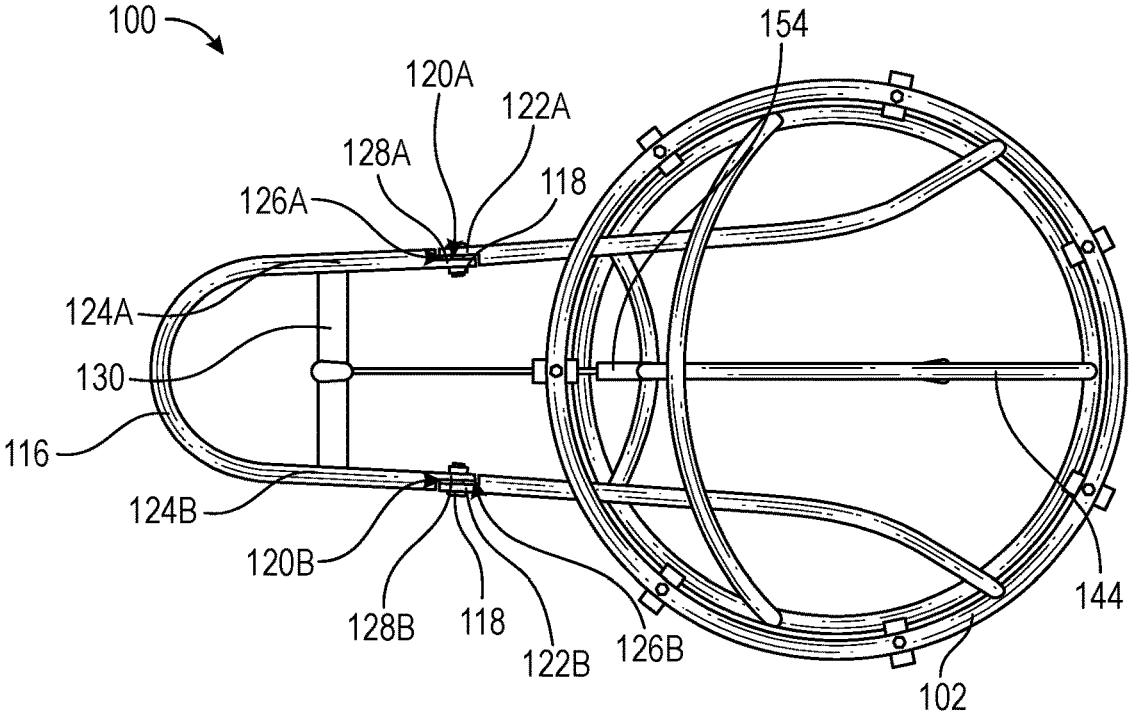
FIG. 3 illustrates a top plan view of a basketball rebounding apparatus.
Figure 4:
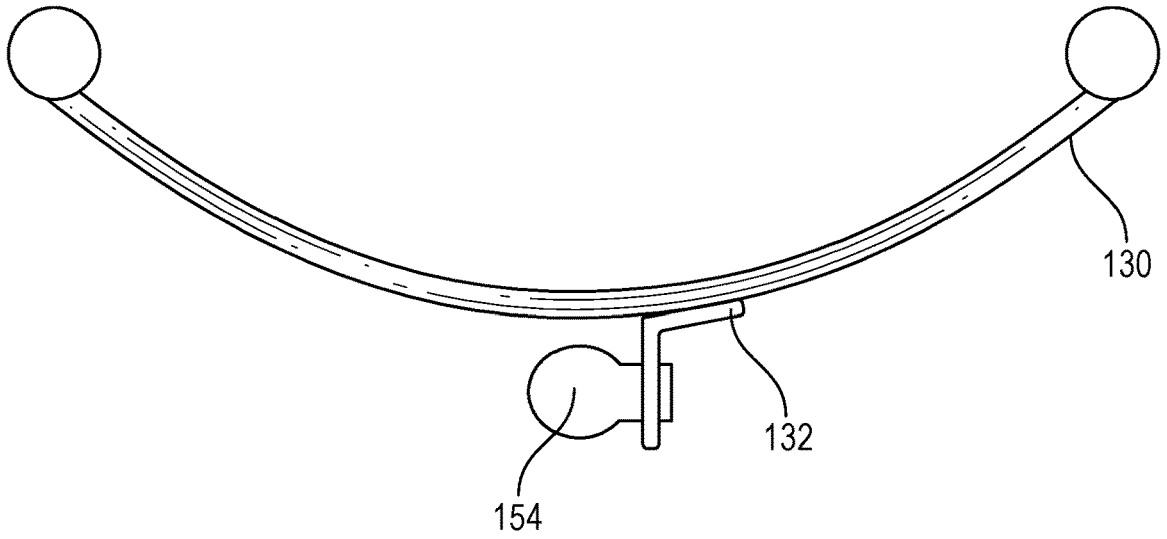
FIG. 4 illustrates a support member and a first bracket of a basketball rebounding apparatus.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed. Rather, the present disclosure will cover all modifications, equivalents, and alternatives falling within the scope of the present disclosure.

Reference to the invention, the present disclosure, or the like are not intended to restrict or limit the invention, the present disclosure, or the like to exact features or steps of any one or more of the exemplary embodiments disclosed herein. References to "one embodiment," "an embodiment," "alternate embodiments," "some embodiments," and the like, may indicate that the embodiment(s) so described may include a particular feature, structure, or characteristic, but not every embodiment necessarily includes the particular feature, structure, or characteristic.

Any arrangements herein are meant to be illustrative and do not limit the invention's scope. Although specific terms are employed herein, they are used in a generic and descriptive sense only and not for purposes of limitation. Unless otherwise defined herein, such terms are intended to be given their ordinary meaning not inconsistent with that applicable in the relevant industry and without restriction to any specific embodiment hereinafter described.

It will be understood that the steps of any such processes or methods are not limited to being carried out in any particular sequence, arrangement, or with any particular graphics or interface. In fact, the steps of the disclosed processes or methods generally may be carried out in various, different sequences and arrangements while still being in the scope of the present invention. Certain terms are used herein, such as "comprising" and "including," and similar terms are meant to be "open" and not "closed" terms. These terms should be understood as, for example, "including, but not limited to."

As previously described, there is a need for an apparatus that can be used alone or with others, increases a player's strength, timing, and jumping skills, and is easy to use. The present invention seeks to solve these and other problems.

Basketball is an important part of American culture and is played by children, youth and adults throughout the country. Not only is basketball important for some as a recreational activity, it is also important for many who attempt to make a living from it. As such, training and developing basketball skills is essential. An essential skill that all basketball players need, is that of rebounding the basketball. To develop this skill, requires hours and hours of work. A part of developing this skill is increasing strength and coordination (e.g., timing). Many rebound trainings have been developed. However, some of these are difficult to learn, especially without a coach. In addition, multiple trainings may be needed to develop both strength and timing.

The basketball rebounding apparatus described herein comprises a first frame including a first arm and a second arm that leads to a second frame. The second frame may be hingedly coupled to the first and second arms, thereby allowing the second frame to descend away from the first and second arms. The basketball rebounding apparatus may also comprise a spring that controls the second frame. In particular, when a basketball passes through the basketball hoop and the basketball rebounding apparatus, it will travel towards the second frame via the first and second arms. Once the basketball contacts the second frame, it will be in a stationary position until removed by a user. To remove the basketball, a user would have to jump up and grab the basketball, pulling it down with enough force to release the tension in the spring until the basketball is free. It will be appreciated that the basketball rebounding apparatus may increase strength and timing of a user. It will further be appreciated that the basketball rebounding apparatus may be removably attachable. Thus, it may be transported from one basketball hoop to another.

Figure 5:
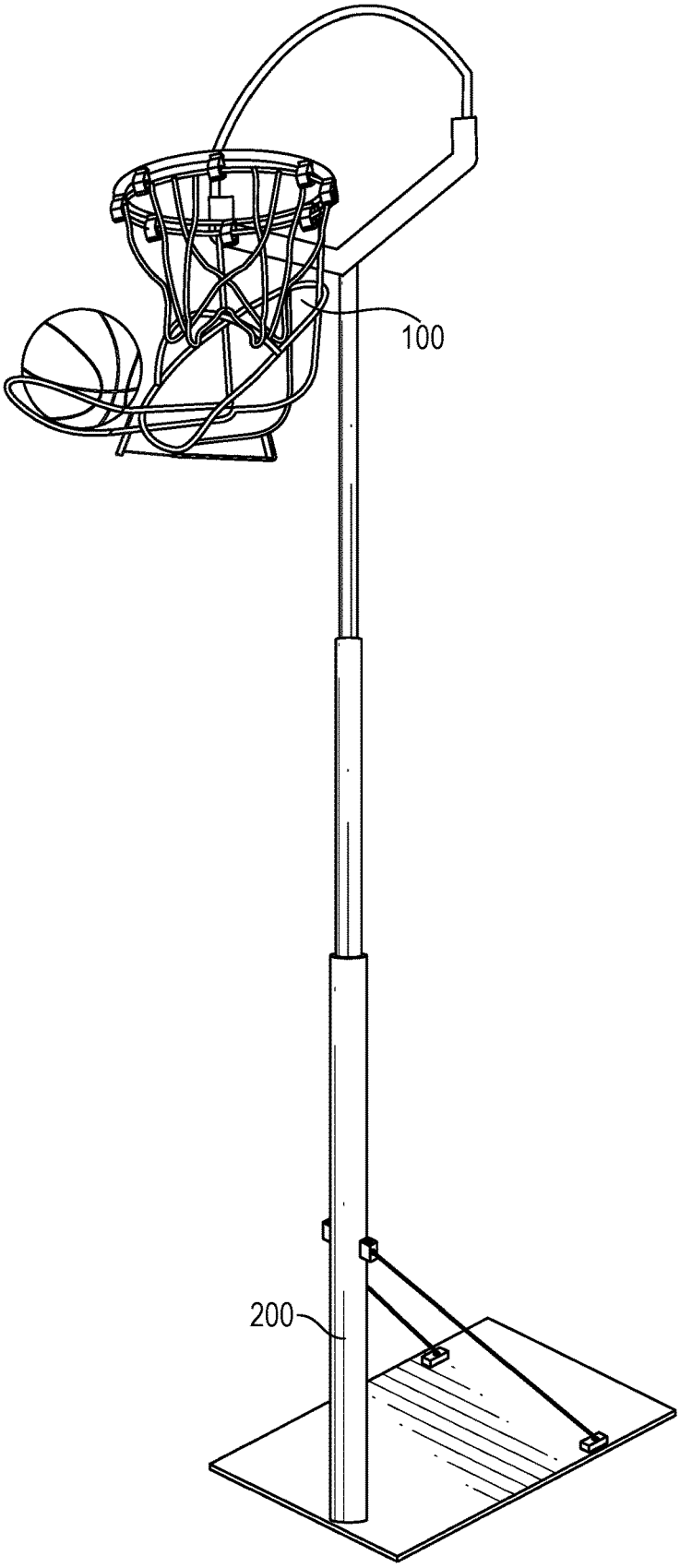
FIG. 5 illustrates a perspective view of a basketball rebounding apparatus coupled to a basketball hoop.

As shown in FIGS. 1-4, in one embodiment, a basketball rebounding apparatus 100 comprises a first frame 102 with a first arm 104A and a second arm 104B. The first frame 102 may be cylindrical so as to match the size and shape of a conventional basketball rim. The first frame 102 may rest upon an upper surface of a basketball rim, as shown in FIG. 5. In some embodiments, the first frame 102 may comprise various shapes, such as square-shaped or ovular at a size to receive a men's, women's, or youth basketball. The first frame 102 may comprise an aperture 106 that allows a basketball to pass therethrough. Further, the first frame 102 may vary in diameter, which could make the aperture 106 that leads to the basketball hoop smaller, for example, so as to help a user's shooting accuracy.

The first frame 102 may comprise a plurality of first fasteners 108 so as to allow the first frame 102 to couple to the basketball rim. The first fasteners 108 may be spaced apart an equal distance around the first frame 102 and descend below the first frame 102. In some embodiments, the first fasteners 108 may be positioned above the first frame 102. The first fasteners 108 may comprise a first finger 110A and a second finger 110B at a first end, with a channel 111 interposed between the first and second fingers 110A, 110B. The first and second fingers 110A, 110B may be manufactured from a rubber, plastic, or metal material that is pliable so as to grip the basketball rim. The first channel 111 on the first fasteners 108 is configured to receive the basketball rim. At a second end, the first fastener 108 may comprise a nut that couples to a bolt. While the first fastener 108 is shown as having a bolt and nut, it will be understood that the first fastener 108 may include a clip, a cotter pin, a safety pin, a clevis pin, or any other type of fastening mechanism. The bolt may be coupled to the first and second fingers 110A, 110B. For example, the bolt may be molded into material positioned between the first and second fingers 110A, 110B. It will be understood that the first fastener 108 may pass through the first frame 102 and be removably attachable thereto. When the first fasteners 108 are in position, the first frame 102 may be coupled to the basketball rim. It will be appreciated that while the first fastener 108 is shown as a clamp with a bolt, the first fastener 108 may, in some embodiments, be comprised of brackets, screws, or any other type of fastening mechanism.

The first and second arms 104A, 104B may couple to a bottom surface of the first frame 102 via, for example, welding, nuts and bolts, or any other type of coupling mechanism. In particular, a first end 112A and a second end 112B of the first and second arms 104A, 104B, respectively, may couple to the first frame 102. Further, a third end 114A and a fourth end 114B (opposite the first and second ends 112A,112B) of the first and second arms 104A, 104B, respectively, may receive a second frame 116 that is hingedly coupled thereto with a second fastener 118 (e.g., screws, pins, bolts and nuts). In particular, the third and fourth ends 114A, 114B of the first and second arms 104A, 104B may comprise a first recessed portion 120A and a second recessed portion 120B, respectively (shown in FIG. 3). Due to the first and second recessed portions 120A, 120B, the third end 114A of the first arm 104A may also comprise a first finger 122A, and the fourth end 114B of the second arm 104B may comprise a second finger 122B. The second frame 116 may be u-shaped and comprise a third arm 124A and a fourth arm 124B. The third arm 124 of the second frame 116 may comprise a third recessed portion 126A and a third finger 128A. The fourth arm 124B of the second frame 116 may comprise a fourth recessed portion 126B and a fourth finger 128B. The first finger 122A may be positioned in the third recessed portion 126A and the third finger 128A may be positioned in the first recessed portion 120A. The second finger 122B may be positioned in the fourth recessed portion 126B and the fourth finger 128B may be positioned in the second recessed portion 120B. Accordingly, the second frame 116 may move from an upright position to a lowered position.

Further, the second frame 116 may be angled upward in relation to the third and fourth ends 114A, 114B of the first and second arms 104A, 104B. The second frame 116 may further comprise a support member 130 (FIG. 4) that may be coupled to a lower surface of the second frame 116, thereby adding additional support. The support member 130 may be perpendicular to the third and fourth arm 124A, 124B on the second frame 116. The support member 130 may include a first bracket 132 coupled thereto that has a first bracket aperture and a first bracket fastener. It will be appreciated that the second frame 116 can hold a basketball in place so that a user can pull it from the second frame 116. That is, after a user shoots the basketball and it goes in the basketball hoop, the basketball will pass through the basketball rebounding apparatus 100 until stopping on the second frame 116, where it will stay until removed by a user.

The basketball rebounding apparatus 100 further includes a cage 134 coupled thereto that retains a basketball 136 after a user shoots the ball into the basketball hoop. The cage 134 may comprise a first cage member 138, a second cage member 140, a third cage member 142, and a fourth cage member 144 (FIG. 1). The first cage member 138 may be coupled to a rear side of the first and second arms 104A, 104B in one or more locations. The first cage member 138 may comprise a first cage member end 146A and a second cage member end 146B. The second cage member 140 may be coupled to the first cage member 138 and extend over the first and second arms 104A, 104B so as to retain the basketball in the basketball rebounding apparatus 100 once it enters the basketball hoop. The third cage member 142 may be positioned under the first and second arms 104A, 104B and be coupled to the first and second arms 104A, 104B and/or the first cage member end 146A and the second cage member end 146B. The third cage member 142 may be positioned between the first and second arms 104A, 104B, perpendicular thereto, so as to add support and act as an additional guide as the basketball rolls to the second frame 116. The fourth cage member 144 may be positioned in between the first and second arms 104A, 104B and be parallel thereto. The fourth cage member 144 may couple to the first cage member 138 at one end and the third cage member 142 at an opposite end. The fourth cage member 144 may comprise a second bracket 148 that descends below the fourth cage member 144. The second bracket 148 may comprise a second bracket aperture 150 and a second bracket fastener 152.

In addition, a spring 154 (e.g., a pneumatic spring) may control the motion of the second frame 116. That is, when a user places a certain amount of pressure on the spring 154, the second support 116 may lower, thereby releasing a basketball to the user. The spring 154, for example, may be coupled to the fourth cage member 144 and the support member 130 via the first and second brackets 132, 148. While a pneumatic spring is shown, it will be appreciated that metal wire springs may be used or any other type of spring mechanism. In some embodiments, the spring 154 may comprise an adjustable tensioner, so as to increase or decrease tension, thereby making it easier to remove the basketball or harder. In other embodiments, the spring 154 may be removably attachable to the basketball rebounding apparatus 100, and the basketball rebounding apparatus 100 may utilize additional pneumatic springs that vary with regard to tension so that youth or adults may be able to remove the basketball from the second frame 116 by releasing the pneumatic spring 154.

As shown in FIG. 5, the basketball rebounding apparatus 100 may be coupled to a basketball hoop. It will be appreciated that once the basketball rebounding apparatus 100 is coupled to the rim of the basketball hoop, a user may shoot the basketball through the basketball hoop so as to position the basketball on the second frame 116. At that point, a user may jump up and pull the basketball down, thereby activating the spring 154 to release the basketball. After the basketball is removed, the second frame 116 via the spring 154 may reset to a resting position, ready to receive another basketball.

Figure 6:
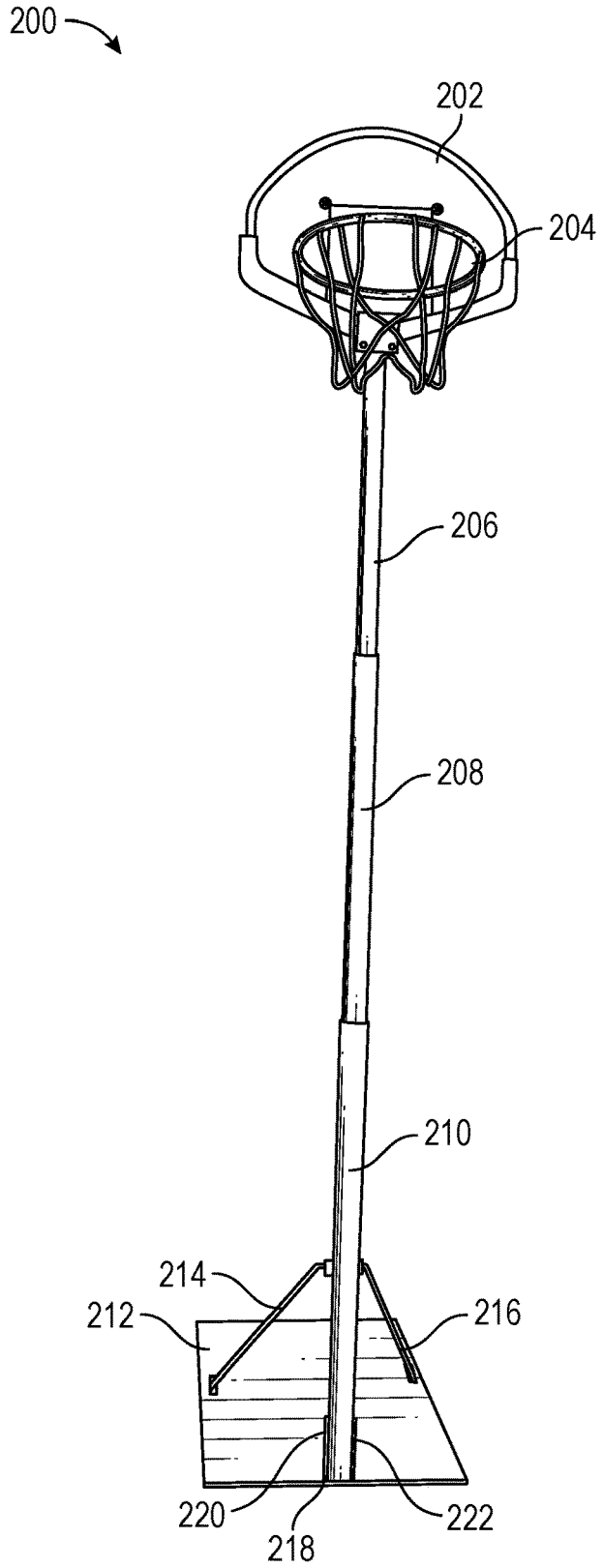
FIG. 6 illustrates a front perspective view of an adjustable basketball hoop.
Figure 7:
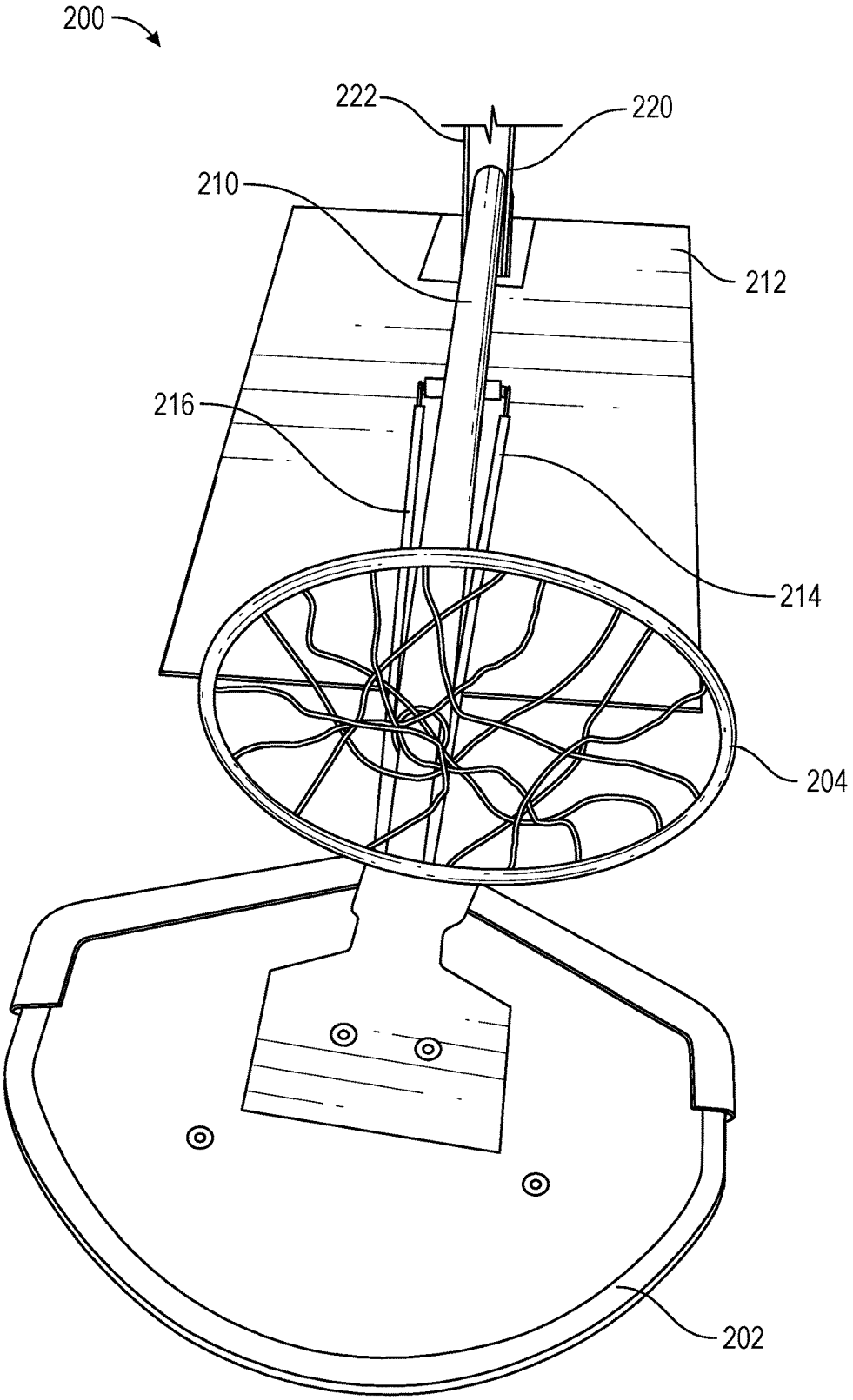
FIG. 7 illustrates a top perspective view of an adjustable basketball hoop.

In one embodiment, as illustrated in FIGS. 6-7, an adjustable basketball hoop 200 comprises a back panel 202 (i.e., backboard), a rim 204, a first shaft 206 positionable into a second larger shaft 208 and the first and second shafts 206, 208 positionable into a third shaft 210 that is larger than both the first and second shafts 206, 208. With the shafts 206, 208, 210 positionable one inside the other, the adjustable basketball hoop 200 can be raised or lowered to numerous heights. The adjustable basketball hoop 200 further comprises a base 212 with a first support arm 214 and a second support arm 216 both hingedly coupled to the third shaft 210. In addition, the third shaft 210 is coupled to the base 212 via a bracket 218 comprising a first sidewall 220 and a second sidewall 222. It will be appreciated that the third shaft 210 may be hingedly coupled to the bracket 218 so that the third shaft 210 may fold and contact the base 212. Once against the base 212, the adjustable basketball hoop 200 may be easily transported. In some embodiments, the adjustable basketball hoop 200 may be used in tandem with the basketball rebounding apparatus 100 to increase basketball skills.

As shown in FIGS. 8-13, in one embodiment, a basketball rebounding apparatus 300 comprises a first frame 302 removably attachable to a first arm 304A and a second arm 304B. The first frame 302 may be cylindrical and rest upon an upper surface of a basketball rim. In some embodiments, the first frame 302 may comprise various shapes, such as square-shaped or ovular at a size to receive a men's, women's, or youth basketball. The first frame 302 may comprise an aperture 306 that allows a basketball to pass therethrough. Further, the first frame 302 may vary in diameter, which could make the aperture 306 that leads to the basketball hoop smaller, for example, so as to help a user's shooting accuracy.

Figure 8:
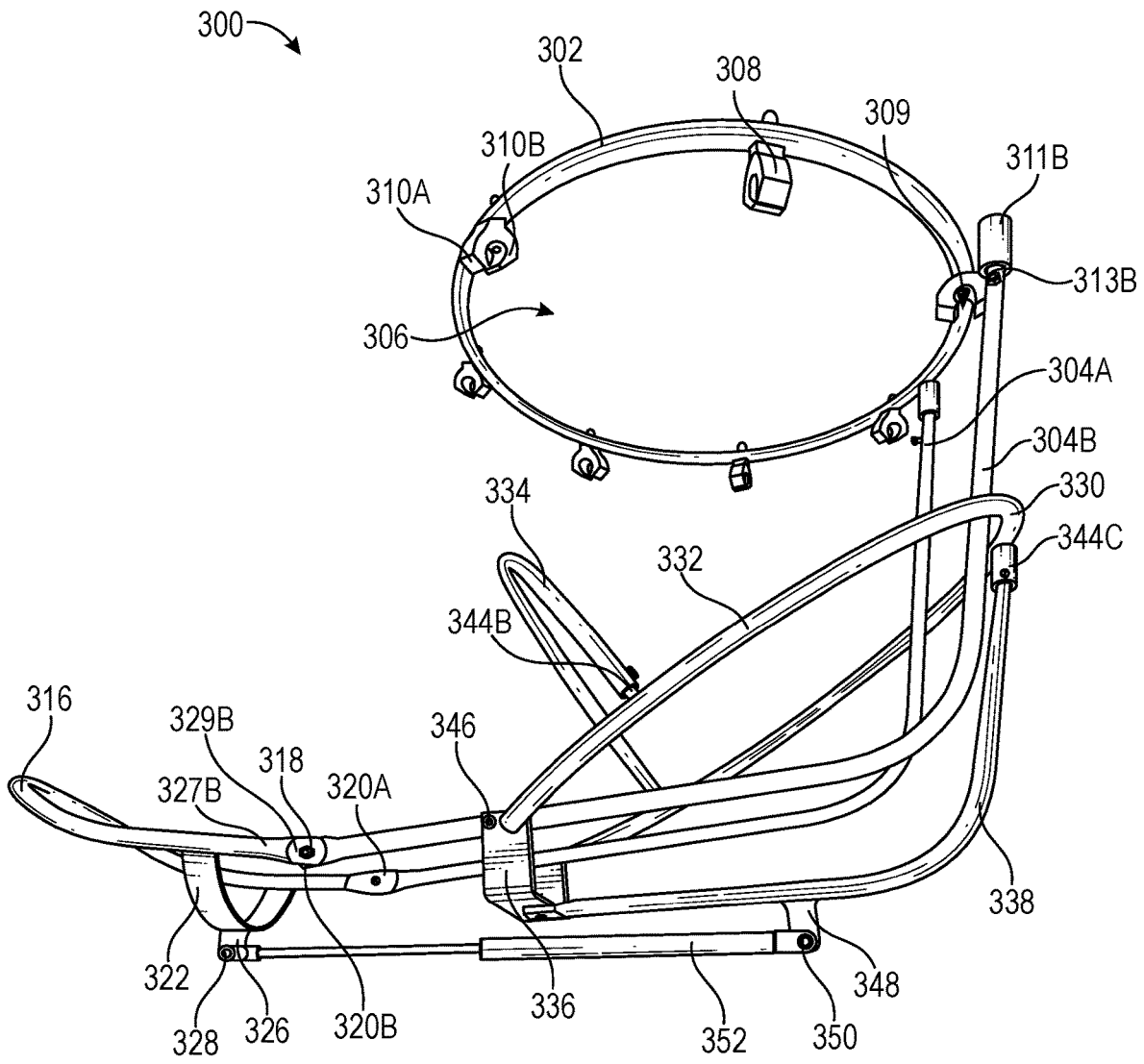
FIG. 8 illustrates a right, side perspective view of a basketball rebounding apparatus.
Figure 9:
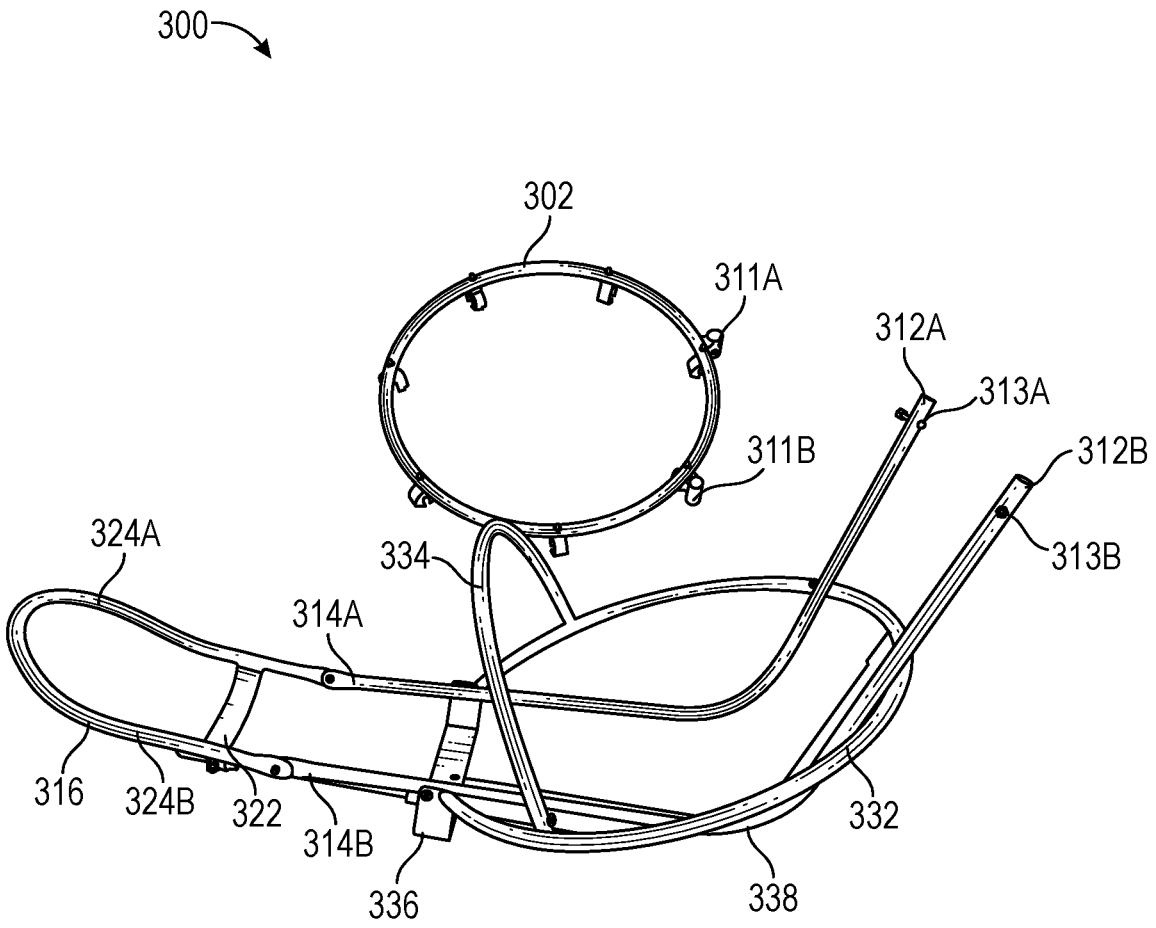
FIG. 9 illustrates a right, side perspective view of a basketball rebounding apparatus with a first frame removed.
Figure 10:
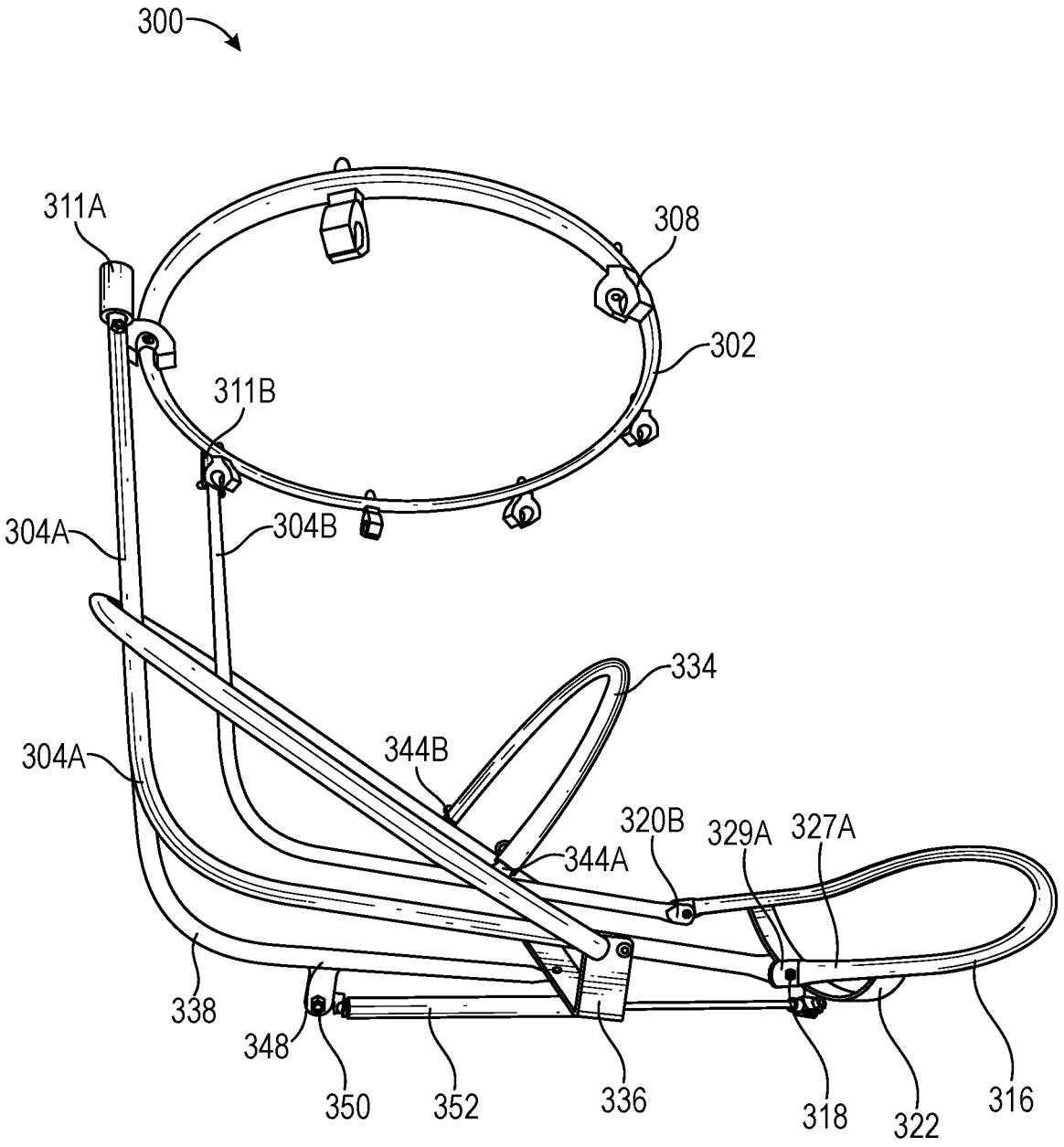
FIG. 10 illustrates a left, side perspective view of a basketball rebounding apparatus.

Referring to FIGS. 8-10, the first frame 302 may comprise a plurality of first fasteners 308 so as to allow the first frame 302 to couple to the basketball rim. The first fasteners 308 may comprise a first finger 310A and a second finger 310B at a first end, with a channel 309 interposed between the first and second fingers 310A, 310B. At a second end, the first fastener 308 may comprise a nut that couples to a bolt. The bolt may be coupled to the first and second fingers 310A, 310B. It will be understood that the first fastener 308 may pass through the first frame 302 and be removably attachable thereto. When the first fasteners 308 are in position, the first frame 302 may be coupled to the basketball rim. It will be appreciated that while the first fastener 308 is shown as a clamp with a bolt, the first fastener 308 may, in some embodiments, be comprised of brackets, screws, or any other type of fastening mechanism. Furthermore, the first frame 302 may comprise a first receiving member 311A (e.g., a tube) that interacts with a first receiving fastener 313A and a second receiving member 311B (e.g., a tube) that interacts with a second receiving fastener 313B. The first and second receiving members 311A, 311B may be configured to receive the first and second arms 304A, 304B and be removably attachable. The first and second receiving members 311A, 311B may be generally cylinder-shaped so that the first and second arms 304A, 304B may be inserted therein, meaning the first and second receiving members 311A, 311B are larger in diameter than the first and second arms 304A, 304B. In some embodiments, the first and second receiving members 311A, 311B are smaller in diameter than the first and second arms 304A, 304B so that the first and second receiving members 311A, 311B may be positioned in the first and second arms 304A, 304B. The first and second receiving fasteners 313A, 313B are shown as nuts and bolts; however, other fasteners may be utilized, such as cotter pins or lynch pins.

The first and second arms 304A, 304B may couple to a bottom surface of the first frame 302 as discussed above or via welding, or any other type of coupling mechanism. In particular, a first end 312A, 312B of the first and second arms 304A, 304B may couple to the first frame 302. Further, a second end 314A, 314B of the first and second arms 304A, 304B may receive a second frame 316 that is hingedly coupled thereto with a second fastener 318 (e.g., screws, pins, bolts and nuts). In particular, the second end 314A, 314B of the first and second arms 304A, 304B may comprise a first flattened end 320A and a second flattened end 320B both with apertures therethrough.

Further, the second frame 316 may be angled upward in relation to the second ends 314A, 314B of the first and second arms 304A, 304B. The second frame 316 may further comprise a support member 322 that may be coupled to a lower surface of the second frame 316, thereby adding additional support and providing a resting location for a basketball. The support member 322 may be perpendicular to a third arm 324A and a fourth arm 324B of the second frame 316. The support member 322 may include a first bracket 326 coupled thereto that has a first bracket aperture and a first bracket fastener 328. The second frame 316 may comprise a third end 327A and a fourth end 327B on the third arm 324A and the fourth arm 324B, respectively. The third end 327A may comprise a third flattened end 329A and the fourth end 327B may comprise a fourth flattened end 329B. The first flattened end 320A may contact and be hingedly coupled to the third flattened end 329A via the second fastener 318. The second flattened end 320B may contact and be hingedly coupled to the fourth flattened end 329B via the second fastener. It will be appreciated that the second frame 316 can hold a basketball in place so that a user can pull it from the second frame 316. That is, after a user shoots the basketball and it goes in the basketball hoop, the basketball will pass until stopping on the second frame 316 and support member 322, where it will stay until removed by a user.

Figure 11:
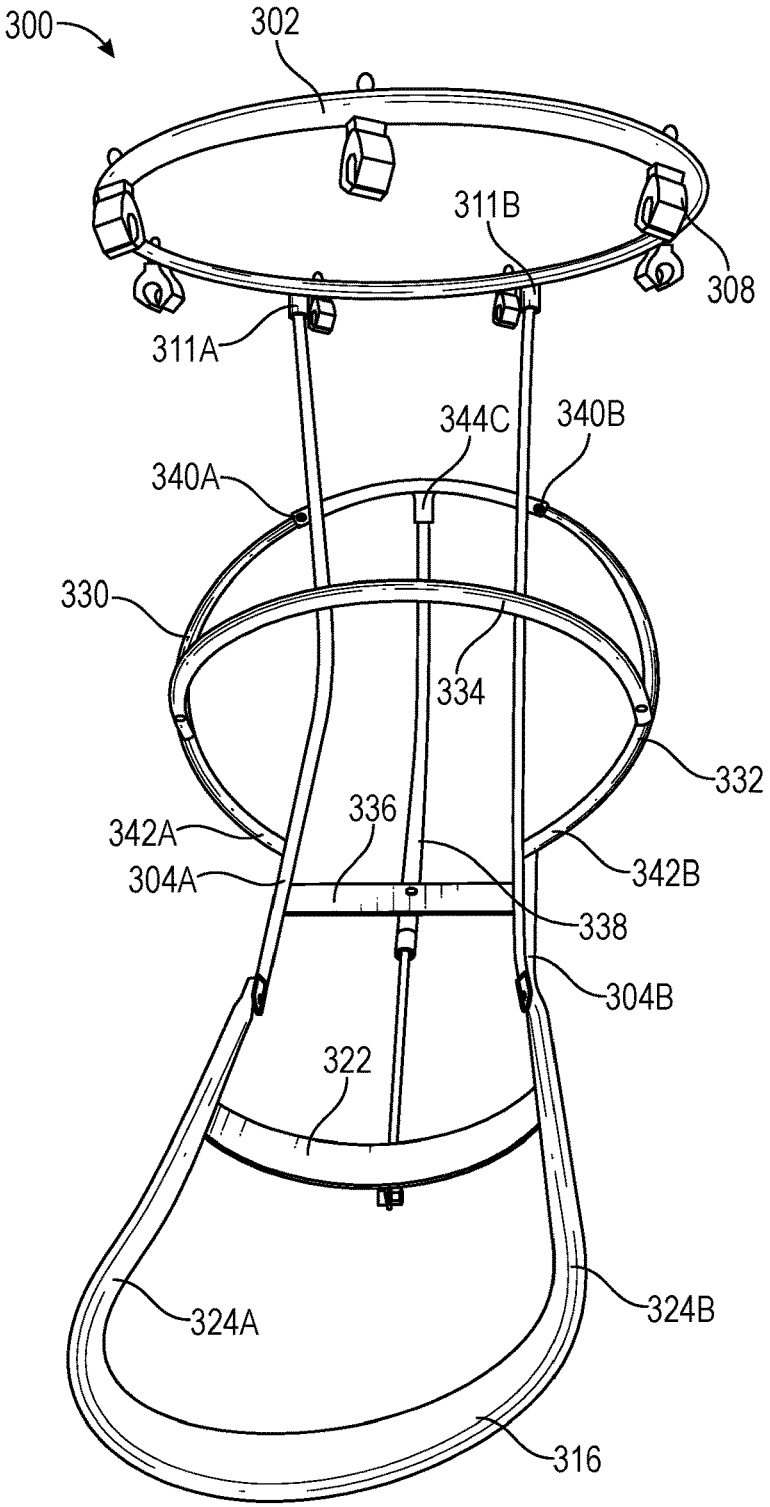
FIG. 11 illustrates a front perspective view of a basketball rebounding apparatus.
Figure 12:
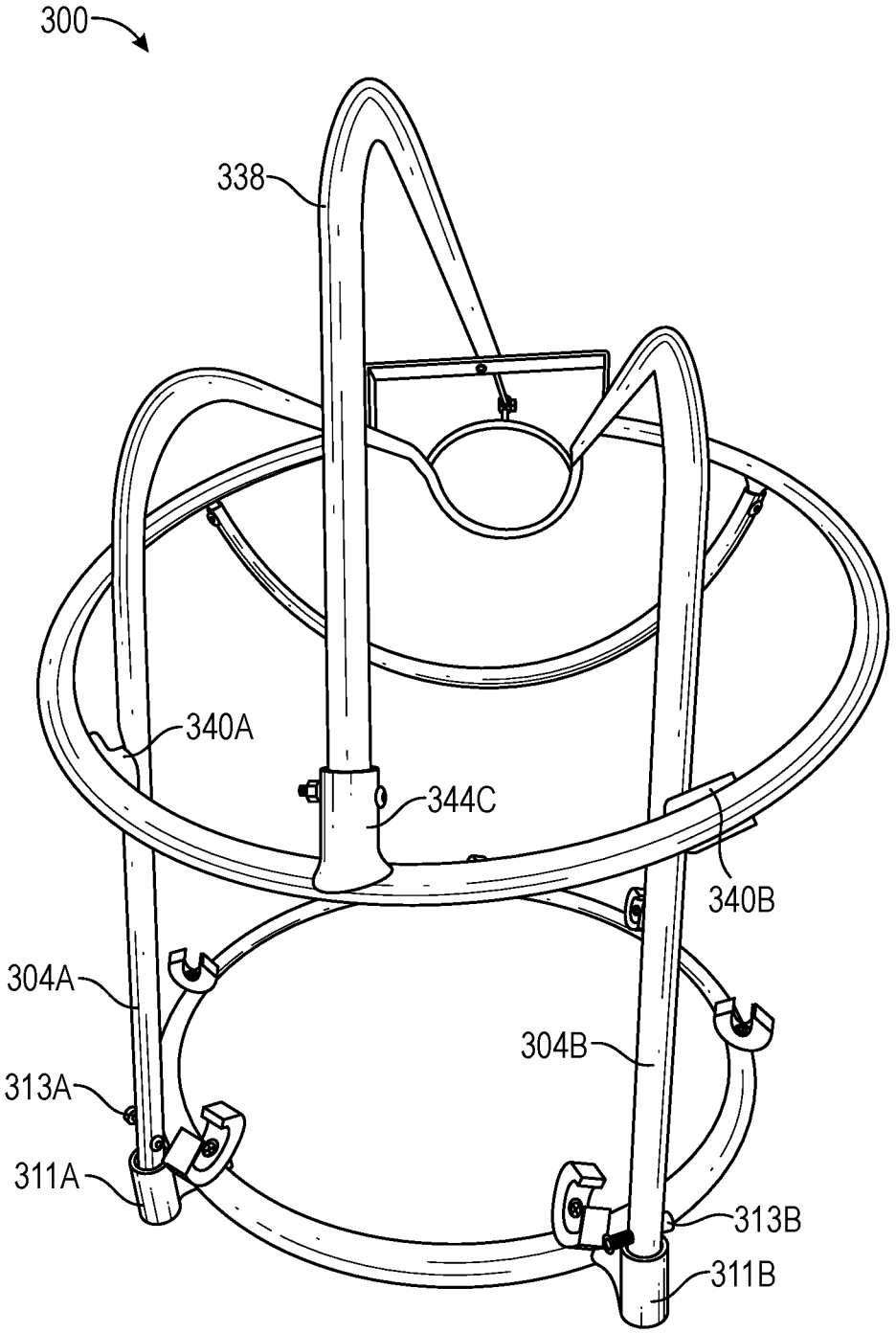
FIG. 12 illustrates a rear perspective view of a basketball rebounding apparatus.
Figure 13:
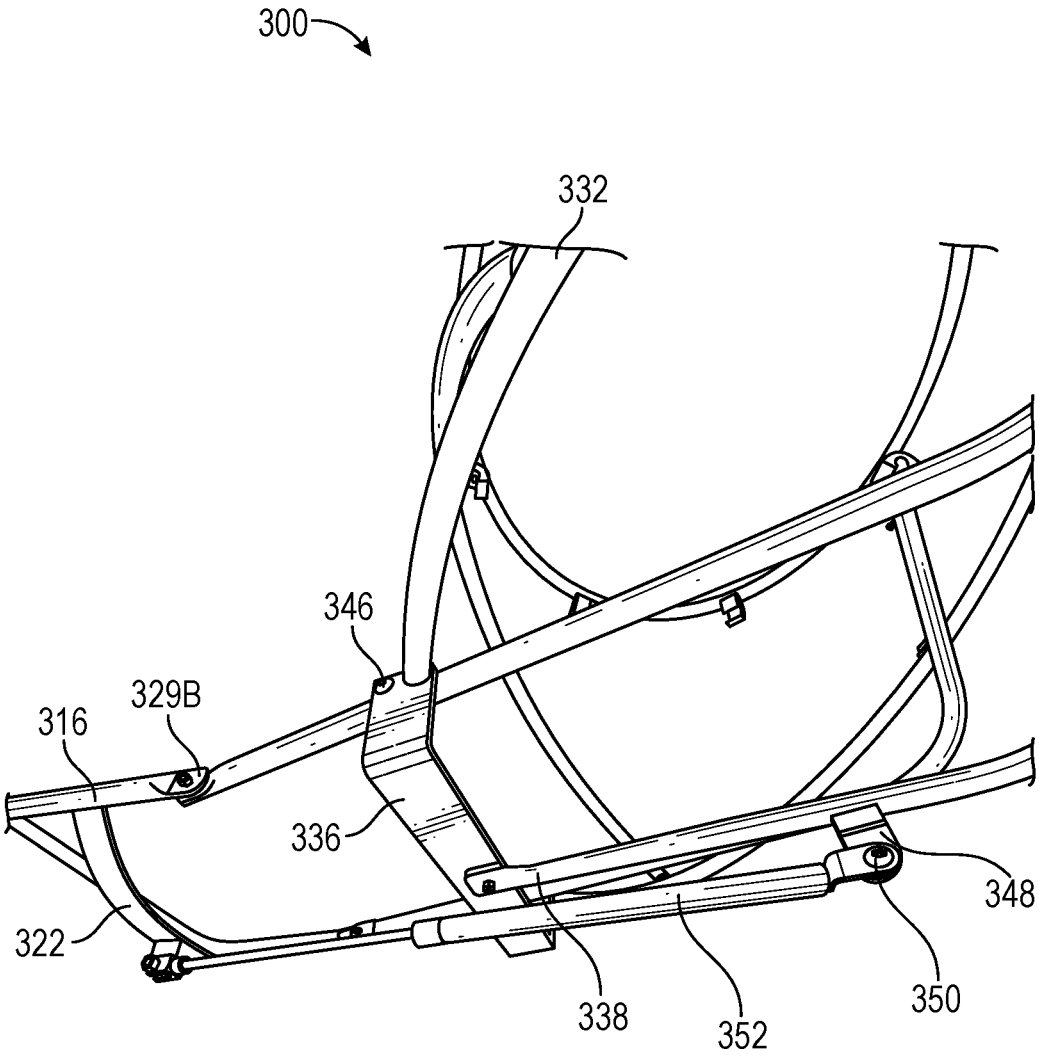
FIG. 13 illustrates a bottom perspective view of a basketball rebounding apparatus.

Referring to FIGS. 11-13, the basketball rebounding apparatus 300 further includes a cage 330 coupled thereto that retains a basketball after a user shoots the ball into the basketball hoop. That is, as the basketball enters the first frame 302 and rolls down the first and second arms 304A, 304B, the cage 330 keeps the ball in the apparatus 300. The cage 330 may comprise a first cage member 332, a second cage member 334, a third cage member 336, and a fourth cage member 338.

The first cage member 332 may be coupled to a rear side of the first and second arms 304A, 304B in at least two locations. More particularly, the first cage member 332 may couple to the first and second arms 304A, 304B via a first, curved coupler 340A on the first arm 304A and a second, curved coupler 340B on the second arm 304B. The first and second curved couplers 340A, 340B may comprise bolts, lynch pins, etc. The first and second curved couplers 340A, 340B may be configured in size and shape to mate with the first cage member 332. That is, both the first and second curved couplers 340A, 340B may comprise a first and a second concave portion, respectively, that are each configured to receive the first cage member 332. The first cage member 332 may comprise a first cage member end 342A and a second cage member end 342B.

The second cage member 334 may be coupled to the first cage member 332 so as to retain the basketball in the basketball rebounding apparatus 300 once it enters the basketball hoop. The second cage member 334 may be removably attachable to the first cage member 332 via bolts and nuts, lynch pins, etc. through one or more second cage apertures. To be coupled to the first cage member 332, the second cage member 334 may be placed on a first protrusion 344A and a second protrusion 344B both of which may be extending upward from the first cage member end 342A and the second cage member end 342B, respectively. The first protrusion 344A (FIG. 10) may comprise a first protrusion aperture and the second protrusion 344B (FIG. 8) may comprise a second protrusion aperture. Both the first protrusion aperture and the second protrusion aperture may align with the second cage apertures so as to receive the fastening mechanism, such as bolts or lynch pins. The first cage member 332 may include a third protrusion 344C extending downward. The third protrusion 344C may comprise third protrusion apertures to receive a fastener similar to those mentioned above, such as a bolt and nut or lynch pin. The third protrusion 344C may be configured to receive an end of the fourth cage member 338 therein so as to be removably attachable thereto.

The third cage member 336 may be positioned under the first and second arms 304A, 304B and be coupled to the first cage member end 342A, the second cage member end 342B, and the first and second arms 304A, 304B (shown in FIG. 13). As an example, the first and second cage member ends 342A, 342B may be welded, or secured through other fastening mechanisms, to outer sides of the third cage member 336, and the third cage member 336 may be coupled to the first and second arms 304A, 304B via bolts 346 or any other means of securement. The third cage member 336 may be positioned between the first and second arms 304A, 304B, being perpendicular thereto, so as to add support and act as an additional guide as the basketball rolls to the second frame 316.

The fourth cage member 338 may be positioned in between the first and second arms 304A, 304B and be parallel thereto. The fourth cage member 338 may couple and be removably attachable to the first cage member 332 at one end and the third cage member 336 at an opposite end. The fourth cage member 338 may comprise a flattened end that contacts the bottom surface of the third cage member 336 so as to be secured. The fourth cage member 338 may comprise a second bracket 348 that descends below the fourth cage member 338. The second bracket 348 may comprise a second bracket aperture and a second bracket fastener 350.

In addition, a spring 352 (e.g., a pneumatic spring) may control the motion of the second frame 316. That is, when a user places a certain amount of pressure on the spring 352, the second support 316 may lower, thereby releasing a basketball to the user. The spring 352 may be coupled to the fourth cage member 338 and the support member 322 via the first and second brackets 326, 348. While a pneumatic spring is shown, it will be appreciated that metal wire springs may be used or any other type of spring mechanism. In some embodiments, the spring 352 may comprise an adjustable tensioner, so as to increase or decrease tension, thereby making it easier to remove the basketball or harder. In other embodiments, the spring 352 may be removably attachable to the basketball rebounding apparatus 300, and the apparatus 300 may utilize additional pneumatic springs that vary with regard to tension so that youth or adults may be able to remove the basketball from the second frame by releasing the pneumatic spring 352.

The basketball rebounding apparatus 300 may be coupled to a basketball hoop. It will be appreciated that once the basketball rebounding apparatus 300 is coupled to the rim of the basketball hoop, a user may shoot the basketball through the basketball hoop so as to position the basketball on the second frame 316, the second frame 316 being in a first, resting position. At that point, a user may jump up and pull the basketball down, thereby activating the spring 352 to release the basketball, moving the second frame 316 to a second, release position. After the basketball is removed, the second frame 316 via the spring 352 may automatically reset to the first position, ready to receive another basketball.

It will be understood that while various embodiments have been disclosed herein, other embodiments are contemplated. Further, certain embodiments of the present disclosure may include, incorporate, or otherwise comprise properties or features described in other embodiments. Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure.

The embodiments described herein are examples of the present disclosure. Accordingly, unless a feature or component is described as requiring another feature or component in combination therewith, any feature herein may be combined with any other feature of a same or different embodiment disclosed herein. Although only a few of the example embodiments have been described in detail herein, those skilled in the art will appreciate that modifications are possible without materially departing from the present disclosure described herein. Accordingly, all modifications may be included within the scope of this invention.

What is claimed is:

1. A basketball rebounding apparatus comprising:

a first frame comprising a removably attachable first arm and a removably attachable second arm;

a plurality of first fasteners removably attachable to the first frame;

a second frame hingedly coupled to the first arm and the second arm at an end opposite the first frame;

a support member positioned on and coupled to a lower surface of the second frame, the second frame, when in a first position, holds a basketball, the support member comprising a first bracket coupled to a lower surface of the support member; and a cage that retains the basketball in the basketball rebounding apparatus, the cage comprising:

a first cage member, a second cage member, a third cage member, and a fourth cage member, the fourth cage member comprising a second bracket that has a second bracket aperture and a second bracket fastener.

2. The basketball rebounding apparatus of claim 1, wherein the plurality of first fasteners each comprise, at a first end, a first finger, a second finger, and a channel interposed between the first and second fingers, the channel receives a rim of a basketball hoop.

3. The basketball rebounding apparatus of claim 1, wherein the plurality of first fasteners comprise, at a second end, a bolt and nut to couple the plurality of first fasteners to the first frame.

4. The basketball rebounding apparatus of claim 1, wherein the second frame is coupled to the first arm and the second arm via a second fastener.

5. The basketball rebounding apparatus of claim 1, wherein the second frame is a u-shaped frame.

6. The basketball rebounding apparatus of claim 5, wherein the u-shaped frame comprises a third arm and a fourth arm.

7. The basketball rebounding apparatus of claim 6, wherein the support member is perpendicular to and coupled to the third and fourth arms.

8. The basketball rebounding apparatus of claim 1, wherein the first cage member couples to a rear side of the first and second arms.

9. The basketball rebounding apparatus of claim 1, wherein the second cage member is coupled to the first cage member.

10. The basketball rebounding apparatus of claim 1, wherein the second bracket receives an actuator that couples to and actuates the second frame.

11. The basketball rebounding apparatus of claim 10, wherein the actuator comprises a pneumatic spring.

12. A basketball rebounding apparatus comprising:

a first frame with a first arm and a second arm;

a plurality of first fasteners removably attachable to the first frame, the plurality of first fasteners each comprise, at a first end, a first finger, a second finger, and a channel interposed between the first and second fingers that receives a rim of a basketball hoop;

a second frame hingedly coupled to the first arm and the second arm at an end opposite the first frame, the second frame, when in a first position, holds a basketball;

a support member positioned on and coupled to a lower surface of the second frame;

a first bracket coupled to a lower surface of the support member;

a cage that retains the basketball in the basketball rebounding apparatus, the cage comprising:

a first cage member coupled to a rear side of the first and second arms, a second cage member coupled to the first cage member, a third cage member coupled to a bottom side of the first and second arms, and a fourth cage member;

wherein the second frame moves from the first, resting position to a second, release position when downward force is placed on the second frame.

13. The basketball rebounding apparatus of claim 12, wherein the first cage member comprises a first cage member end and a second cage member.

14. The basketball rebounding apparatus of claim 12, further comprising a second bracket that is coupled to a lower surface of the fourth cage member.

15. The basketball rebounding apparatus of claim 14, wherein the first bracket and second bracket receive an actuator.

16. The basketball rebounding apparatus of claim 15, wherein the actuator comprises a spring and a tensioner.

17. A basketball rebounding apparatus comprising:

a first frame comprising a first receiving member and a second receiving member;

a first arm removably attachable to the first receiving member;

a second arm removably attachable to the second receiving member;

a plurality of first fasteners removably attachable to the first frame, the plurality of first fasteners each comprise, at a first end, a first finger, a second finger, and a channel interposed between the first and second fingers that fastens to a rim of a basketball hoop;

a second frame hingedly coupled to the first arm and the second arm at an end opposite the first frame;

a support member positioned on and removably attachable to a lower surface of the second frame, the second frame, when in a first position, holds a basketball;

a first bracket coupled to a lower surface of the support member;

a cage that retains the basketball in the basketball rebounding apparatus, the cage comprising:

a first cage member coupled to a rear side of the first and second arms, a second cage member coupled to the first cage member, a third cage member coupled to a bottom side of the first and second arms, and a fourth cage member;

a second bracket that is coupled to a lower surface of the fourth cage member;

an actuator coupled to the first bracket and the second bracket.

* * * * *